US012716330B2

(12) United States Patent
Leuchtenberg et al.

(10) Patent No.: US 12,716,330 B2
(45) Date of Patent: Aug. 25, 2026

(54) WELL INTEGRITY SYSTEM AND METHOD

(71) Applicant: ADS SERVICES, LLC, Midland, TX (US)

(72) Inventors: Christian Leuchtenberg, Shamrock Park (SG); Charles Orbell, Satellite Beach, FL (US)

(73) Assignee: ADS SERVICES, LLC, Midland, TX (US)

( * ) Notice: Subject to any disclaimer, the term of this patent is extended or adjusted under 35 U.S.C. 154(b) by 0 days.

(21) Appl. No.: 18/870,039

(22) PCT Filed: May 30, 2023

(86) PCT No.: PCT/GB2023/051420
§ 371 (c)(1),
(2) Date: Nov. 27, 2024

(87) PCT Pub. No.: WO2023/233139
PCT Pub. Date: Dec. 7, 2023

(65) Prior Publication Data

US 2025/0327376 A1 Oct. 23, 2025

Related U.S. Application Data

(60) Provisional application No. 63/346,936, filed on May 30, 2022.

(51) Int. Cl.
*E21B 41/00* (2006.01)
*E21B 34/08* (2006.01)
*E21B 47/117* (2012.01)

(52) U.S. Cl.
CPC ..... *E21B 41/0021* (2013.01); *E21B 34/08* (2013.01); *E21B 47/117* (2020.05)

(58) Field of Classification Search
CPC .... E21B 34/08; E21B 41/0021; E21B 47/117; E21B 2200/20; E21B 2200/22
See application file for complete search history.

(56) References Cited

U.S. PATENT DOCUMENTS

| | | | |
|---|---|---|---|
| 8,353,351 | B2 | 1/2013 | Carpenter et al. |
| 8,413,677 | B1 | 4/2013 | Coffman et al. |
| 8,579,032 | B2 | 11/2013 | Fenton |
| 9,835,009 | B2 | 12/2017 | Hess et al. |
| 10,527,068 | B2 | 1/2020 | Parthasarathy et al. |
| 2011/0114333 | A1 | 5/2011 | Fenton |

(Continued)

FOREIGN PATENT DOCUMENTS

| | | | |
|---|---|---|---|
| GB | 2546100 | A | 7/2017 |

OTHER PUBLICATIONS

International Search Report dated Jul. 26, 2023 (3 pages) from PCT Priority Application PCT/GB2023/051420.

(Continued)

*Primary Examiner* — Nicole Coy
*Assistant Examiner* — Nicholas D Wlodarski
(74) *Attorney, Agent, or Firm* — Crowell & Moring LLP

(57) ABSTRACT

A remotely operable Wellbore Integrity System for large scale monitoring of annular pressure on production wells. The system enhances the integrity of annular casing strings associated with mineral wellbores. The system can be autonomously deployed and has programmable pressure relief valves enabling remote adjustment of the casing pressure.

22 Claims, 3 Drawing Sheets

(56) References Cited

U.S. PATENT DOCUMENTS

| | | | | |
|---|---|---|---|---|
| 2016/0222741 | A1* | 8/2016 | Lovorn | E21B 34/00 |
| 2021/0332652 | A1* | 10/2021 | Muraikhi | E21B 47/06 |
| 2022/0003071 | A1* | 1/2022 | Ahmari | E21B 47/10 |
| 2022/0065069 | A1 | 3/2022 | Aulia | |
| 2024/0117731 | A1* | 4/2024 | Alerwi | G05B 23/0291 |

OTHER PUBLICATIONS

International Preliminary Report on Patentability and Written Opinion ofthe International Searching Authority dated Nov. 7, 2024 (7 pages) from PCT Priority Application PCT/ GB2023/051420.

* cited by examiner

WELL INTEGRITY SYSTEM AND METHOD

This application is a national application based on Patent Cooperation Treaty Patent Application No. PCT/GB2023/051420, filed on May 30, 2023, which claims priority under 35 U.S.C. § 119(e) to U.S. Provisional Patent Application No. 63/346,936, filed on May 30, 2022, the entire contents of each of which are incorporated herein by reference.

BACKGROUND OF THE INVENTION

Field of Invention

This invention relates in general to protection of casings for wellbores that are being drilled or have been drilled and completed. More specifically, the systems and methods described enable the pro-active management of casing relief pressures from drilling a well to end of life.

Description of Related Art

Producing and injecting wells usually have a central tubular the production or injection string. On the outside of this working string with fluid flow is a static fluid containing string called a casing that creates an annulus around the production string that is isolated at the bottom by a packer and at the top by a tubing hanger in the wellhead. This annulus is usually filled with a fluid that serves as an isolation fluid. The outside of this casing is usually cemented. As a newly completed well is brought to production the production tubing heats up due to producing fluid and this temperature increase in turn heats up the annulus leading to possible pressure increases inside the casing that can be measured at a valve exit on the wellhead that is in communication with this annulus. Pressure may need to be bled off to keep the casing below a burst pressure of the casing or other limiting pressure of the completion components or to prevent collapse of the production tubing.

When drilling a well, this casing pressure protection is usually not considered. However, when drilling a well it is possible to get a casing leak caused by a well control incident, geo-mechanical events, cement failure or casing being worn out by drilling, and overpressure in a casing string could cause more problems than the original incident. This is becoming more of a problem with increasing well drilling activity in aging fields like in Saudi Arabia and in areas with high density drilling where multiple reservoirs that are intersected by new wellbores may have depletion in some layers, leading to low pressure intervals, and concurrent water injection in some layers, leading to high pressure intervals, as is the norm in the Permian Basins of Texas.

Over the production life of the well, when it has been completed after drilling, various problems may occur from lack of cement integrity on the outside of the casing string, packer leaks, tubing leaks, casing leaks caused by general wear and tear due to cycling of pressure, corrosion or geological movements. The consequences of over pressuring the casing adjacent to the tubing can be severe like collapse of the production tubing, casing rupture leading to leaks and also increasing the risk of catastrophic failure. To counter this risk of overpressure in the casing, it is known to provide a pressure gauge which has to be visually inspected in situ, and/or to install various overpressure devices in the wellbore, on the wellhead or on the casing outlet. Such overpressure devices include simple one-shot burst or rupture disks and relief valves, and normally lead to a vent. All of these systems have a single pressure failure or setpoint though some system introduce two different safety valves with different set points as disclosed in US patent application publication no. US 2022/0065069A1 assigned to Saudi Aramco.

Most other prior art safety valve solutions have systems inside the wellbore as disclosed in U.S. Pat. No. 8,579,032 assigned to Vetco Gray; U.S. Pat. No. 9,835,009 assigned to Halliburton, and GB patent publication no. 2,546,100 assigned to GE. All of these have fixed set-point opening pressures. U.S. Pat. No. 8,353,351 discloses a system on the seafloor that is outside the wellbore that would require significant intervention to adjust the set-point.

SUMMARY

According to one embodiment, a wellbore integrity monitoring system, the system including a wellbore lined with a casing string, a production tubing which extends down the wellbore to a reservoir of formation fluid so that fluid from the formation can flow up the production tubing, there being an casing annulus formed between the exterior of the production tubing and the casing string, the system further including a fluid flow line which extends from the casing annulus to a vent, a pressure relief valve which is provided in the fluid flow line and which is movable between a closed position in which flow of fluid along the fluid flow line from the casing annulus to the vent is prevented and an open position in which flow of fluid along the fluid flow line from the casing annulus to the vent is allowed, a valve actuator system which is configured to move the pressure relief valve between its open and closed positions, a pressure sensor which is arranged to measure fluid pressure in the casing annulus, a processor/controller which is connected to the pressure sensor and which is configured to receive and process a pressure signal from the pressure sensor, the processor/controller also being connected to the valve actuator system and configured to control the actuator to move the pressure relief valve from the closed position to the open position if the signal from the pressure sensor indicates that the pressure in the casing annulus is greater than a high pressure set point, wherein the processor/controller has a data input interface and is configured to change the high pressure set point to a new value according to instructions received at the data input interface.

In one embodiment, the processor/controller is also configured to control the actuator to move the pressure relief valve from the open position to the closed position if the signal from the pressure sensor indicates that the pressure in the casing annulus is lower than a low pressure set point. In this case, the processor/controller is configured to change the low pressure set point to a new value according to instructions received at the data input interface.

The pressure sensor may be located in the fluid flow line upstream of the pressure relief valve (i.e., between the pressure relief valve and the casing annulus). Alternatively, the pressure sensor may be located in the casing annulus.

The processor/controller may include a process logic controller (PLC), a local human machine interface (HMI) and a data storage memory.

The pressure relief valve, valve actuator system, and processor/controller may be provided together as a programmable pressure relief valve such as those disclosed in U.S. Pat. Nos. 8,413,677 and 10,527,068 both assigned to the applicant. Use of such a programmable pressure relief valve may be advantageous due to their high degree of reliability, accuracy of set-point opening or closing pressures as well as ability to be electronically programmed to a range of setpoint pressures. These programmable pressure relief valves can be hydraulically actuated and can have a simple solenoid actuated by a set-pressure that instantly opens, allowing hydraulic pressure to move the actuator opening the relief valve based on a high setpoint and similarly recloses instantly with a low pressure set-point.

The processor/controller may include a process logic controller (PLC) provided as part of the pressure relief valve assembly, and at least one further process logic controller.

The system may further include a transceiver which is configured to transmit data to and receive data and/or instructions from a remote location.

The processor/controller may be connected to a central production data acquisition and control system (such as the production SCADA—Supervisory Control And Data Acquisition—system) via a hard-wired connection.

The processor/controller may be configured to transmit data to and receive data and/or instructions from the central production data acquisition and control system via the hard-wired connection.

The system may further include a data storage memory which is configured to store data representing pressure signals received from the pressure sensor.

The system may further include comprise-a clock, and be configured to store data representing data representing pressure signals received from the pressure sensor and the date and time of receipt of each pressure signal.

The system may be further configured to using the data storage memory to store an event log related to at least one of the following events: the pressure in the casing interior reaches the high pressure set point, the pressure in the casing interior reaches the low pressure set point, the processor/controller controls the valve actuator to move the pressure relief valve from the open position to the closed position, and the processor/controller controls the valve actuator to move the pressure relief valve from the closed position to the open position, the event log containing the date, time and nature of the event.

The system may be further configured to transmit to a remote location an event log related to at least one of the following events: the pressure in the casing interior reaches the high pressure set point, the pressure in the casing interior reaches the low pressure set point, the processor/controller controls the valve actuator to move the pressure relief valve from the open position to the closed position, and the processor/controller controls the valve actuator to move the pressure relief valve from the closed position to the open position, the event log containing the date, time and nature of the event.

The system may be further configured to record change in pressure with time after opening the pressure relief valve or closing the pressure relief valve.

The system disclosed is focused on land wells, but can be applied to other wells above sea level in offshore platforms or swamp wellheads. For most fields with large numbers of producing wells there exists a data collection and monitoring system for the production tubing capturing pressure, temperature and flowrate. The problem is that over the producing life of the well, typically 10 to 30 years, the conditions in the producing wellbore change significantly due to changes in Gas Oil Ratio (GOR) as reservoir pressure drops or due to increasing water cut (increased water production). These changes lead to significantly different differential pressures between the tubing and the casing, as the average fluid density in the tubing is changing over time causing the original set-point choice of the relief system to become outdated. Also, due to occurring failures associated with differential pressure caused by corrosion and/or erosion of adjacent wellbores may require the need for a different setpoint for the next lifecycle of the proximate well(s), in order to pro-actively prevent similar failures. Other causes of variations in casing pressure may be geotechnical and geo-mechanical due to settling caused by reservoir depletion. Seismic events can also cause significant stress to wellbore completions cracking casings and/or cement isolation. The influence of these factors on causing failures may require a revision of the casing set point relief pressures.

The disclosed technology may facilitate continued production with risk reduction of casing overpressure and their consequent events. This disclosed technology relates to a Wellbore Integrity System that enables i) easy retrofit to casings for above sea level wells, ii) remote monitoring of the pressures in the casing, iii) actionable changes to the relief or safety valve set-pressure without having to dismantle the wellbore or to carry out work on the wellhead.

Such a Wellbore Integrity System would be deployable autonomously so that it could be easily retrofitted as an independent system. It would be modular consisting of the following modules as required: 1) Data Gathering module; 2) at least one programmable pressure relief valve; 3) Remote Access & Communication module; 4) Venting System; 5) Renewable power supply; 6) Fluid type detection system; 7) Fluid volume/metering module; 8) Injection System. The system would usually have modules 1), 2), 3) & 4) with the other modules as required depending on the customer specifications.

Several Wellbore Integrity Systems will enable the deployment of an Autonomous Annular Pressure monitoring and control network across a field of producing wells enabling the following features:

1. Monitoring the casing annulus pressure for many to all wells in the field.
2. Trending the casing annulus pressure and comparison to similar wells with similar completions.
3. Adjusting the set-points for the pressure relief valves as required over the lifecycle of the wells.
4. Managing the set-point pressure more closely to the limits of the wellbore based on comparative historical data.
5. Ability to estimate the wellbore storage factor in the annulus by carrying out a controlled drawdown of pressure and measuring the volume released by utilizing the ability to change hi and low set-points.

The ability to carry out these functions may lead to significant cost savings by being able to proactively plan maintenance and workover planning for critical wells. This can lead to extending production and field life. There may be a significant increase in safety by reducing the collapse or rupture of tubulars and the catastrophic consequences that can arise out of these failures. There may also an improvement of environmental and sustainability goals. Especially the ability to trend the annular pressure versus time and to optimally adjust the safety relief valve set-point may be a significant upside for ageing production field management.

As the Wellbore Integrity Systems are independent of the main production system, they can be rapidly deployed and redeployed to another well after end of life of a wellbore. Adding a renewable power supply (solar, solar & wind with battery) which can power the programmable pressure relief valve as well as the remote access and communication module, can enable the system to function within minutes of deployment.

The system can consist of the following modules:

1) Data Gathering module contains a Process Logic Controller (PLC) that will handle all of the data inputs as well as any coordination between multiple programmable relief valves. A temperature sensor is provided on the flowline from casing to each programmable relief valve. The temperature sensor serves to monitor ambient temperature and any changes in temperature of the vented fluid that may be indicative of the underlying problem. An optional downstream pressure and temperature sensor may be installed after the programmable relief valve at the Venting module. It is possible to add additional pressure sensors for other casing strings if these are deemed critical to monitor. Any additional data like the data from the fluid monitoring modules 6) and 7) will also be processed with this module. The data is sent to the Remote Access and Communication (RAC) module 4).
2) Programmable pressure relief valves (PPRV) that are designed for high reliability service established in the drilling, intervention, well testing and fracturing environments. They are hydraulically operated with programmable high and low pressure set-points. The PPRV includes a Programmable Logic Controller (PLC) and a local Human Machine Interface (HMI) and memory to store pressure/temperature data and set-point pressures. The power comes from an inbuilt Hydraulic Power Unit (HPU) with accumulator(s) that uses compressed air as the driving force for the hydraulic pump in the HPU. For critical applications two PPRVs can be deployed on the same casing. They would be tied in by a flowline to the casing outlet. Each PPRV can be programmed with a high pressure set-point for relief and a low pressure set-point for reclosing to trap any required or desired pressure. There will typically be a pressure gauge that is monitoring the annulus pressure of the casing that provides the pressure for activation of the set-points. It is possible to add additional PPRVs with pressure sensors for other casing strings if these are deemed critical to monitor and protect. The PPRVs may be password protected to prevent un-authorized changes to set-points.
3) Remote Access and Communication (RAC) module has the option to be tied into an existing production SCADA system or it can send/receive data and instructions via a modem. This modem can be cellular, LPWAN, satellite or point to point radio depending on what is required for that producing area. The RAC has a programmable logic controller (PLC) powered by incoming electric utility with a battery back-up. This module may be password protected to prevent un-authorized communication.
4) Venting System would be what is required by the operator for that field. This may include one or more check valves and/or flame arrestors as well as a Pressure/temperature sensor.
5) Renewable power supply would typically be a solar panel with a charge controller and an electrical power storage battery. It may be supplemented by wind power for low sunshine areas. Each programmable pressure relief valve has an in-built Hydraulic Power Unit (HPU) which is powered by compressed air. Therefore the Renewable power supply may also have an air compressor and compressed air storage tank to provide the recharge power for the HPU of the PPRVs.
6) Fluid type detection system. This is an option that would allow the density of the fluid being vented to be measured. This is a very important feature as it can be used to indicate any gas that has displaced to the top of the annulus or if any other wellbore fluids different to the completion fluid have entered the annulus. This may aid in trending analysis.
7) Fluid volume/metering module to enable the accurate recording of volume removed when bleeding pressure from the annulus. This may facilitate pro-active actions to determine the fluid type and distribution in the annulus by being able to determine the wellbore storage factor for the annulus by recording the volume bled off per unit of pressure released. By having the programmable relief valve PPRV remotely programmable and controllable it may be possible to create a planned drawdown of pressure in the casing annulus or when an unplanned release has happened the data of volume versus time or time versus pressure will give a good indication of what is going on in the annulus after further interpretation.
8) Injection System. There may be instances where there is a desire to reintroduce fluid into the annulus of the casing. This can be accommodated by having a reservoir with an injection pump as part of the Wellbore Integrity System when required.

The wellbore integrity monitoring system does not need to have all of these modules However it may have at least the four following modules: 1) Data Gathering module; 2) at least one programmable pressure relief valve; 3) Remote access and communications module and 4) Venting system. Other modules are enhancements that can be added to enable particular methods of use.

The data and instructions for several such systems can be combined to give an overall system that is an Autonomous Annular Pressure Monitoring Network that can be used to monitor the casing pressure for all the wells in a particular producing field. This system will have information on the producing intervals of the reservoirs for each wellbore (these can be multiple intervals for some wellbore completions). It can provide data into the filed historian database or access such data. The reservoir/producing interval information coupled with the individual wellbore integrity monitoring systems enables pro-active management of the set-points of the programmable pressure relief valve PPRV as well as using the data gathered to establish trending and use it to: i) manage the life of the well; ii) prevent wellbore incidents caused by annular pressure; and iii) manage the maintenance and workover windows for the field by prioritizing critical wells identified by casing pressure data and relief events.

In addition to the embodiments described above, methods of using the two systems are provided: 1) wellbore integrity monitoring system and 2) Autonomous Annular Pressure Monitoring as described.

According to one embodiment a method of operating a wellbore monitoring system including a fluid flow line which extends from the interior of a wellbore casing to a vent, a programmable pressure relief valve which is provided in the fluid flow line and which is movable between a closed position in which flow of fluid along the fluid flow line from the casing annulus to the vent is prevented and an open position in which flow of fluid along the fluid flow line from the casing annulus to the vent is allowed, a valve actuator system which is configured to move the pressure relief valve between its open and closed positions, a pressure sensor which is arranged to measure fluid pressure in the casing annulus, a processor/controller which is connected to the pressure sensor and which is configured to receive and process a pressure signal from the pressure sensor, the processor/controller also being connected to the valve actuator system and configured to control the actuator to move the pressure relief valve between the closed position and the open position, wherein the method includes the steps of:

a) using the pressure sensor to monitor the pressure in the interior of the casing and if the signal from the pressure sensor indicates that the pressure in the interior of the casing is greater than a high pressure set point, using the processor/controller to operate the valve actuator to move the pressure relief valve from the closed position to the open position, b) allowing fluid from the interior of the casing to flow to the vent, and c) if the signal from the pressure sensor indicates that the pressure in the interior of the casing is lower than a low pressure set point, using the processor/controller to control the valve actuator to move the pressure relief valve from the open position to the closed position.

The method may include using the pressure sensor to monitor the pressure in the interior of the casing. The system may further include a data storage memory, and the method include using the data storage memory to store data representing pressure signals received from the pressure sensor.

The system may further include a clock, and the method include using the data storage memory to store data representing pressure signals received from the pressure sensor, and the date and time of receipt of each pressure signal.

The system may further include a transmitter and the method include using the transmitter to transmit a pressure signal from the pressure sensor to a remote location. Where the system also includes a clock, the method may also include using the transmitter to transmit the time of receipt of the pressure signal to the remote location.

The processor/controller may have a data input interface and the method may further include transmitting instructions to the data input interface of the processor/controller change one or both of the high pressure set point or the low pressure set point, and the processor/controller storing the new high pressure set point and/or low pressure set point.

The method may include transmitting instructions to the data input interface to the data input interface from a remote location via a wireless connection.

The processor/controller may have a data input interface and the method may further include using the pressure sensor to determine the pressure in the interior of the casing, transmitting instructions to the data input interface of the processor/controller to reset the high pressure set point to a level below the pressure in the interior of the casing, so that the processor/controller to controls the valve actuator to move the pressure relief valve from the closed position to the open position. In this case, the method may also include using the pressure sensor to determine the pressure in the interior of the casing, and the processor/controller to log the pressure signals from the interior of the casing at intervals while the pressure relief valve is in the open position. Where the system includes a transmitter, the method may include using the transmitter to transmit the pressure signals to a remote location.

Where the system includes a clock and a data storage memory, the method may further include using the data storage memory to store an event log related to at least one of the following events: the pressure in the casing interior reaches the high pressure set point, the pressure in the casing interior reaches the low pressure set point, the processor/controller controls the valve actuator to move the pressure relief valve from the open position to the closed position, and the processor/controller controls the valve actuator to move the pressure relief valve from the closed position to the open position, the event log containing the date, time and nature of the event.

Where the system includes a clock and a transmitter, the method may further include using the data storage memory to transmit to a remote location an event log related to at least one of the following events: the pressure in the casing interior reaches the high pressure set point, the pressure in the casing interior reaches the low pressure set point, the processor/controller controls the valve actuator to move the pressure relief valve from the open position to the closed position, and the processor/controller controls the valve actuator to move the pressure relief valve from the closed position to the open position, the event log containing the date, time and nature of the event.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
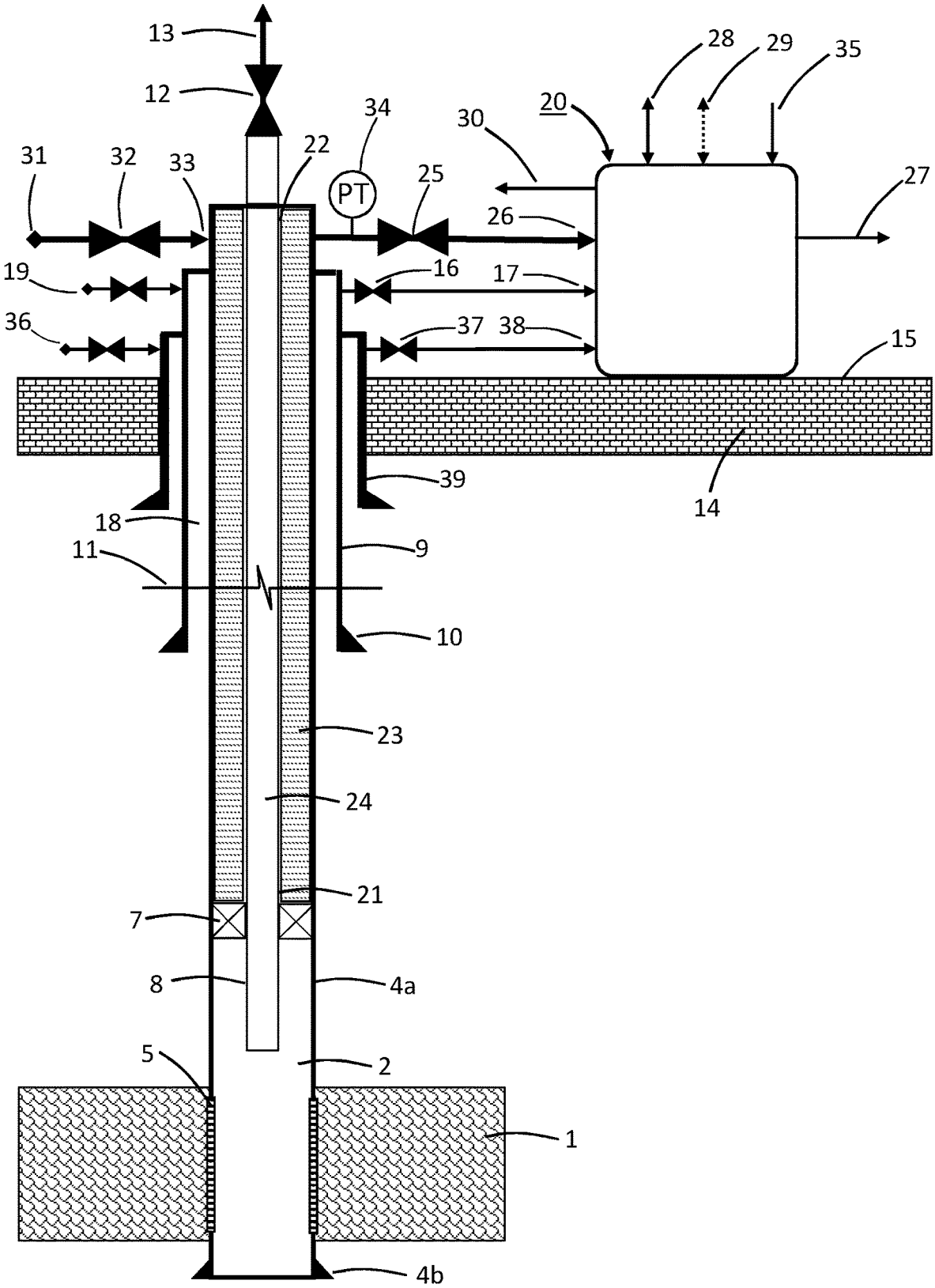
FIG. 1 shows a schematic illustration of a cross-sectional view of an embodiment of an exemplary wellbore with a wellbore integrity system installed according to the disclosed technology.
Figure 2:
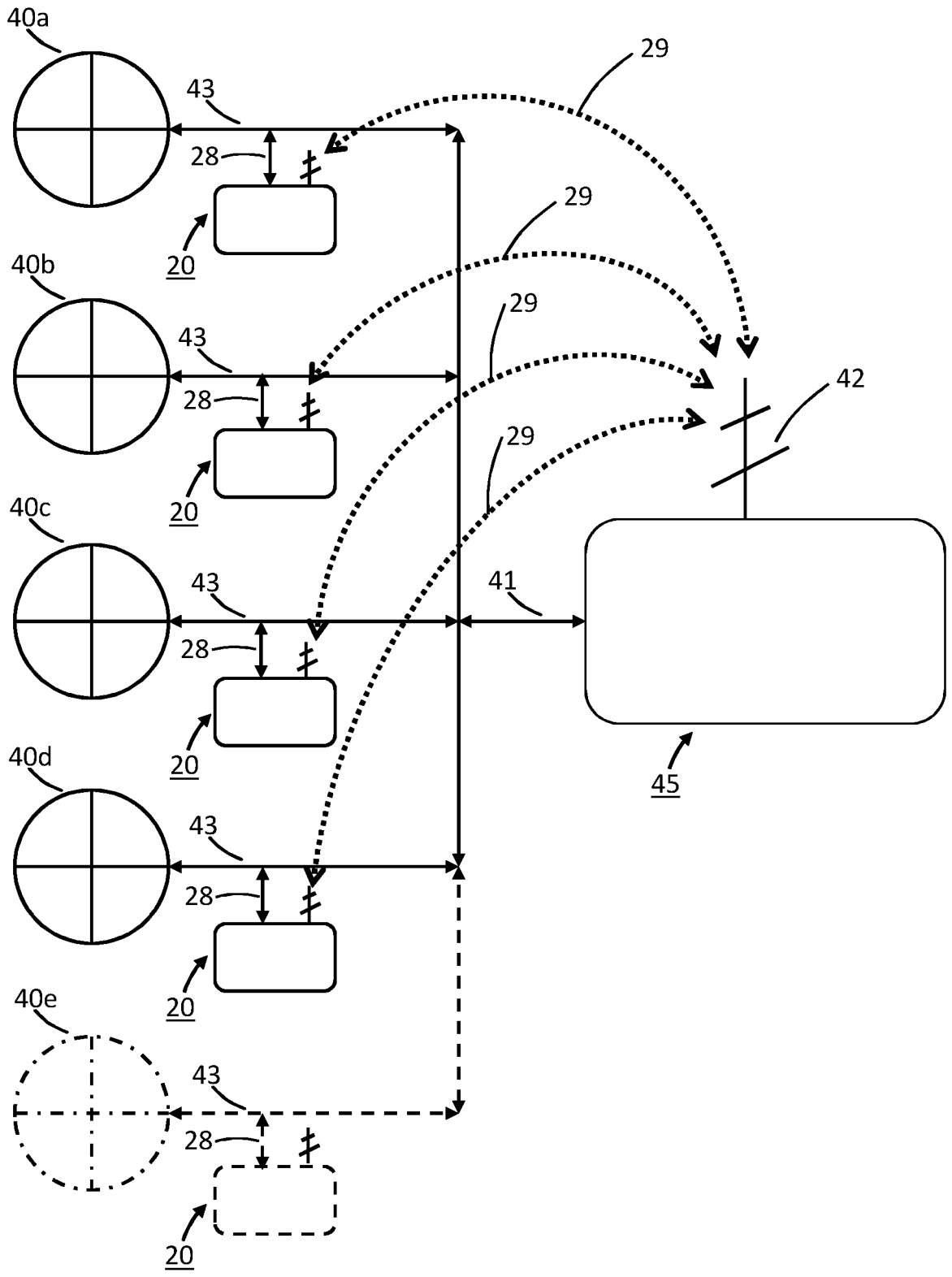
FIG. 2 shows a schematic illustration of an embodiment of an exemplary production field with several installed wellbore integrity systems according to the disclosed technology.
Figure 3:
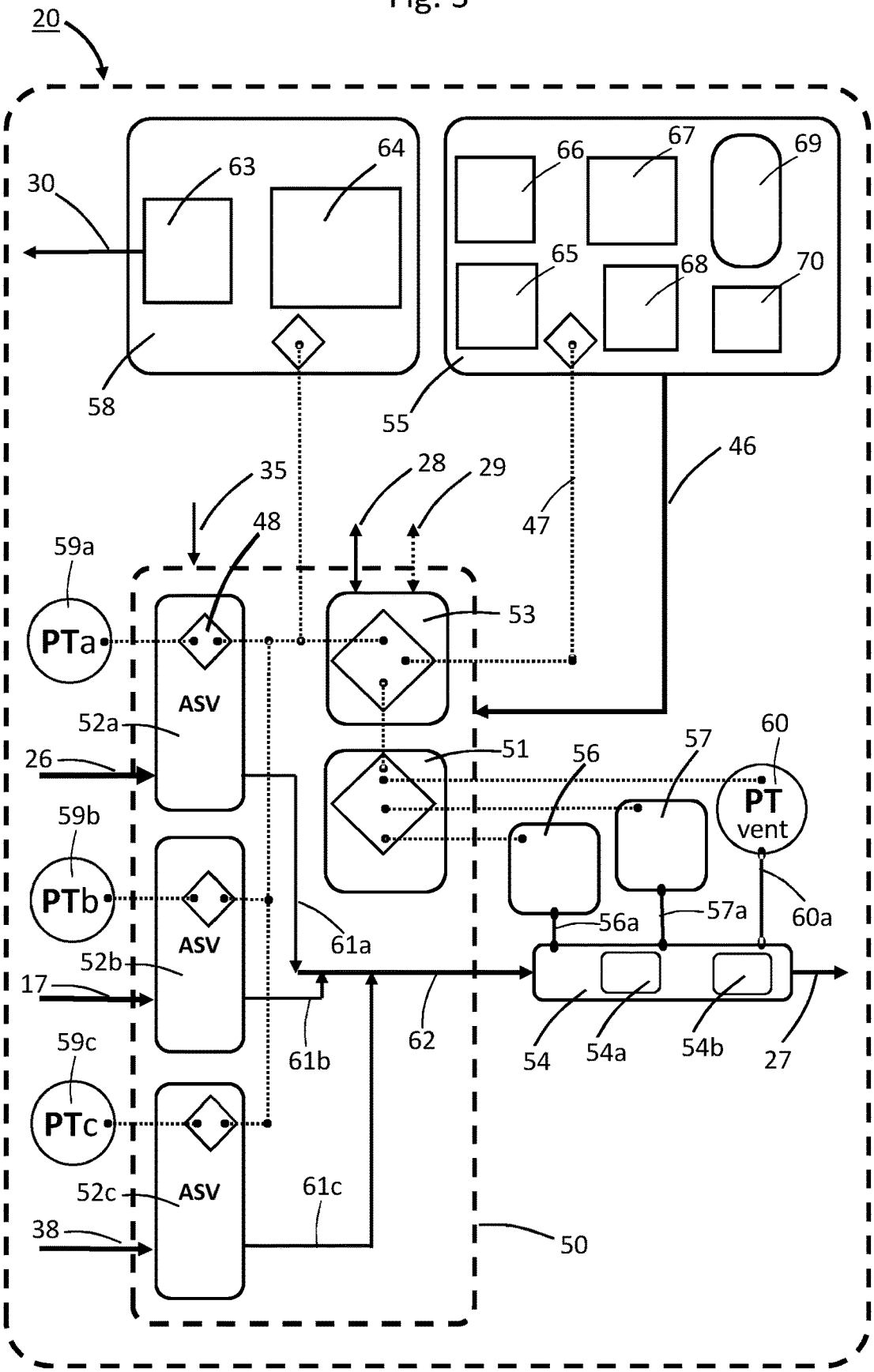
FIG. 3 is a block diagram of an embodiment of a wellbore integrity system according to the disclosed technology.

The problems being solved and the solutions provided by the embodiments of the principles of the present inventions are best understood by referring to FIGS. 1 to 3 of the drawings, in which like numbers designate like parts.

Referring to FIG. 1, this shows a schematic cross-sectional view of an exemplary wellbore with a wellbore integrity monitoring system 20 installed thereon. Starting from the bottom of the drawing we have a producing formation 1, flowing into a wellbore 2, defined by a casing 4*a* with a casing shoe 4*b*, through perforations 5. The flow of formation fluids goes through tubing 8, isolated from the upper part of the casing 4*a* by a packer 7. The fluids flow to the surface through a wellhead valve 12 to production 13. Line 11 shows a discontinuity as the wellbore is several factors longer in reality. There may be additional casing strings exemplified by casing 9 with a casing shoe 10 and casing 39. The surface is shown by 14 with ground level 15.

A Wellbore Integrity System (hereinafter referred to as the WIS) 20 is installed at a suitable location, typically at least 10 meters away at ground level. The inlet 26 of the WIS 20 is connected by a flowline through valve 25 to the casing 4*a* at the wellhead. The modules and components of the WIS are detailed in FIG. 3. The WIS 20 includes at least one programmable pressure relief valve (PPRV) and it has a pressure and temperature transducer 34 that it uses to determine the pressure. When the WIS 20 releases pressure this will travel through vent line 27. There is an optional injection module that is part of the WIS which has an outlet 30 that can be tied in upstream of valve 25 or alternately through a second casing connection point 31 through a valve 32 into casing at point 33. As there may be more than one programmable pressure relief valve PPRV that is part of the modular WIS, this could be used to protect another casing 9 with inlet 17 through valve 16 and correspondingly another injection point 19 for that casing. In fact, a plurality of casing strings may be protected as exemplified by the third casing string 39 with inlet 38 to the WIS 20 through valve 37 and correspondingly another injection point 36 for that casing. There may also be two PPRVs tied in to inlet 26 or any inlet 17 or 38 if two safety/relief valves are mandated.

The WIS 20 may be tied in for communications by hardwire data cable 28 into the existing production well SCADA (Supervisory Control And Data Acquisition) system through the Remote Access and Communications module that is part of the WIS 20. Alternatively the WIS 20 may send data and receive instructions through a wireless link 29. This wireless link can be a satellite communication module, a cellular modem, an LPWAN (Low Power Wide Area Network) modem or a point-to-point radio that interfaces with an existing radio telecommunications network. As can be seen from the schematic, the WIS 20 is an independent unit from the existing wellhead and production system that can be easily retrofitted. It can receive the required utilities like electric power and compressed air through connection 35 if these are readily available on location. If the Renewable Power Supply module is included, then the WIS 20 becomes fully autonomous after installation requiring no utilities on location and being able to send data/receive instructions wirelessly.

The primary purpose of the WIS 20 is to be able to proactively manage the annular casing pressure measured at the surface with pressure transducer 34. There will be a differential pressure between the tubing 8 and the casing 4*a* above the packer 7. This differential pressure is dependent on the fluid density 24 inside the tubing versus the fluid density 23 plus the surface pressure of the casing 4*a*. Depending on the fluid density distribution in the tubing 8, which may be different during a shut-in and the fluid distribution 23 inside the annulus between the casing 4*a* and the tubing 8, there may be variation in differential pressure between the bottom 21 of the completion and the top 22 of the completion. With a fixed pressure relief like a burst disc or standard safety valve, these variations cannot be effectively managed over the life of a well, where significant variations in gas to oil ratio and oil to water ratio occur, as well as dropping reservoir pressure leading to reduced pressure profiles in the tubing. Other problems can occur like leaking packers, breakdown of cement isolation for the casings as well as other leaks or influxes from corrosion erosion or geological effects caused by settling or seismic events. The WIS 20 has the capability to collect data and to pro-actively remotely adjust the casing relief pressure to actively manage the well life and to carry out periodic bleeding of casing pressure as necessary.

FIG. 2 shows a schematic view of an exemplary production field with several installed Wellbore Integrity Systems 20. Four wells 40*a* to 40*d* are shown schematically. Additional wells 40*e* or more can be present. The schematic view is focused on the communications and data transfer to a central command center 45 that is present in large production fields with several wells. In this embodiment, the command center 45 has an incoming main data line 41 that is connected to each well with an individual data line 43 that will collect production data from each well 40*a* to 40*e*+. There may be subcomponents in the data collection and communication system of 43 and 41 that are not shown like PLCs (Programmable Logic Controllers) and RTUs (Remote Terminal Units).

The Wellbore Integrity Systems (WIS) 20 may be tied in to the individual data lines 43 through the hardwired data connection 28 from the PLC in the WIS 20. Alternatively, to speed up deployment the Remote Access and Communications module may use wireless modem/module communication through an antenna as a wireless link 29 back to a receiving antenna 42 at the central command center 45. This may also be relayed via a satellite (not shown) with wireless link 29 sending data to a satellite and this satellite then sending data through a ground relay station to the control center 45. In this manner the new data being collected by the WIS 20 can be analyzed and decisions made with respect to casing relief pressure that are communicated back to the WIS 20 to adjust the set-points as required, this giving the ability to pro-actively manage this important capability from a remote location. If a set-point change is required this can be simply put in as a command from the command center and no mechanical intervention like changing out a rupture disc or a spring on a conventional safety valve is required.

The system of several WISs 20 so described in FIG. 2 creates an "Autonomous Annular Pressure Monitoring and Control Network" (AAPMCN) which can be integrated with the production data system and historian for trending and prediction of annular pressure events. This AAPMCN system will have information on the producing intervals of the reservoirs for each wellbore (these can be multiple intervals for some wellbore completions). This reservoir/producing interval information coupled with the individual Wellbore Integrity Systems 20 enables pro-active management of the set-points of the programmable pressure relief valves as well as using the data gathered to establish trending and use it to: i) manage the life of the well; ii) prevent wellbore incidents caused by annular pressure; and iii) manage the maintenance and workover windows for the field by prioritizing critical wells identified by casing pressure data and relief events.

FIG. 3 is a block diagram of a Wellbore Integrity System 20 showing all the modules:

1. Data gathering module 51
2. Programmable pressure relief valves 52*a*, 52*b* & 52*c*
3. Remote Access and Communication module 53
4. Venting System 54
5. Renewable Power Supply module 55
6. Fluid Type Detection system 56
7. Fluid Volume/Metering module 57
8. Injection System 58

Typically, a Wellbore Integrity System 20 will consist at least of items 51, 52*a*, 53 and 54 with others optional as required. Items 51, 52 and 53 may be combined in a single skid assembly 50. The block diagram of FIG. 3 is schematic. Data & control communication lines 47 (only one numbered) are shown as dotted and PLCs as diamonds 48 (only one numbered) for handling the various data flows and communication requirements for the system.

Describing the function of the PPRV 52*a* that is connected to the incoming line 26: The PLC on the PPRV 52*a* has a high set-point that can be programmed remotely through the Communication module 53 with its PLC instructing the PLC on the PPRV. A low set-point is also programmed. The pressure and temperature transducer 59*a* measures pressure in the casing annulus and the valve 25 (FIG. 1) is open. When the pressure exceeds the high set-point, the PLC on the PPRV 52*a* actuates a solenoid valve and the PPRV opens so that fluid flow is directed through line 61*a* into the main header 62 and onto the vent module 54. The flow exits from the vent module 54 with line out 27 which is tied back to an appropriate point on the well location or drilling pad. This may be a flare or dedicated vent system.

The Vent module 54 may have optionally a check valve(s) 54*a* and/or a flame arrestor 54*b* installed as required. If more than one PPRV is installed there may be check valves on lines 61*a*, 61*b* and 61*c* (not shown). Once the pressure measured by transducer 59*a* drops below the low set-point the PPRV 52*a* will close and isolate the casing from the vent. Similar functions occur with additional PPRVs 52*b* and 52*c* tied into casing lines 17 and 38 respectively.

The PPRV modules 52 are independent units with their own PLCs 48 that can communicate directly to a command-and-control center 45 (FIG. 2) through the communication module 53 through a permanent SCADA connection 28 or through a wireless modem in the module 53 through radio wave connection 29 typically through an appropriate antenna (not shown). There may be other instrumentation as part of the system, typically at least a vent pressure and temperature sensor 60 reading pressure/temperature from the vent module 54 through line 60*a*. The data from this is handled by the PLC in the Data Gathering module 51. If additional modules are installed like the Fluid Type Detection system 56 or a Fluid Volume/Metering system 57, then this data is processed by the PLC in module 51 and then sent through the communication module 53.

The Fluid Type Detection module 56 interfaces through line 56*a* with the fluid in the vent module. This can be a density sampling device or other density measuring device. The Fluid Volume/Metering system 57 can be an orifice plate in which case line 57*a* represents two tapping points upstream and downstream with Fluid Volume/Metering system 57 being a differential pressure gauge. Any manner of systems suited to the fluid application can be installed here.

If there is utility supply at the wellsite, then this, consisting of electric power and compressed air is supplied by utility inlet 35 to the skid 50. The PPRVs 52 have inbuilt hydraulic power units and tanks to charge the accumulator for actuating the valve. If the system requires its own independent power supply, this will be with a Renewable Power Supply module 55 as the power requirement of the Wellbore Integrity System 20 is not much. In this case, Renewable Power Supply module 55 supplies electric power and compressed air through utility connection 46. The Renewable Power Supply module will typically have a solar panel 65 with a charge controller 67 and a storage battery 68. In locations with low sunlight a wind generator 66 may be added for additional power. An electric air compressor 70 with a storage tank 69 provides further power reserve, this being kept at operating pressure ready to send compressed air to the HPUs on the programmable pressure relief valves. The Renewable Power Supply module 55 has a PLC (diamond shape) that interfaces with the Remote Access and Communications module 53 so that the status of power reserve can be monitored.

For some applications a requirement to refill or recompress the annulus may be desirable and for this a separate Injection System module 58 would be supplied. This would typically have a fluid reservoir 64 and a pump 63 that can provide fluid under pressure to the injection line 30. This would also have a PLC (diamond shape) connected back to the Remote Access and Communications module 53 for monitoring purposes. This Injection System module 58 would also require utility connections (not shown) and could possibly be powered from the module 55 (also not shown).

In addition to the embodiments described above, embodiments of the present disclosure further relate to one or more of the following paragraphs:

1. A method for evaluating the risk of failure of individual wellbores by taking the data from individual Wellbore Integrity Systems on each well of a particular production field or producing horizon containing these wells and using it to assign a risk factor based on historical failures. Using this risk factor to assist with the production planning by pro-actively managing set-points of programmable safety valves to reduce the risk of failure of individual wellbores while maximizing the allowable pressure set-point.
2. A method of trending the casing pressure from each well and comparing it to other wells including failed wells to determine the acceptable and safe limits of casing pressure. Then using this data to program the casing pressure relief set-points for individual Wellbore Integrity Systems.
3. A method for taking production data from a producing well consisting of at least: wellhead pressure, wellhead temperature, gas oil ratio and oil to water ratio to estimate the pressure profile along the production tubing, then comparing this pressure profile to the original design pressure profile at the start of well life and using this information to determine the acceptable maximum allowable casing pressure for the well and programming the Wellbore Integrity System with the appropriate set-point.
4. A method whereby a well with a casing pressure above normal but below the set-point of the Wellbore Integrity System is actively instructed to open a programmable relief valve to bleed pressure from the current casing pressure to a lower casing pressure as programmed for the programmable relief valve and measuring the time taken to do so. Measuring the upstream temperature and pressure as well as the downstream pressure and temperature if installed. Using this to estimate the volume of fluid bled. Monitoring the buildup of casing pressure versus time after the programmable pressure relief valve has closed. Using this data to give an indication of the condition of the wellbore and assigning a risk.
5. A method whereby the data gathered by method 4. is enhanced by measuring the density of the fluid released.
6. A method whereby the data gathered by method 4. is enhanced by the volume of fluid measured by a meter or tank.
7. A method whereby the data gathered by method 4. is enhanced by measuring both the density of the fluid released and the volume of fluid measured by a meter or tank.
8. A method whereby a well with a casing pressure above normal automatically triggers the high set-point programmed into a programmable pressure relief valve thus bleeding pressure from the high casing pressure to a lower casing pressure as programmed for the low set-point of the programmable pressure relief valve and measuring the time taken to do so. Measuring the Upstream Temperature and Pressure as well as the Downstream Vent pressure if installed. Using this to estimate the volume of fluid bled. Monitoring the buildup of casing pressure versus time after the programmable pressure relief valve has closed. Using this data to give an indication of the condition of the wellbore and assigning a risk.
9. The method for taking production data from a producing well consisting of at least: wellhead pressure, wellhead temperature, gas oil ratio and oil to water ratio to estimate the pressure profile along the production tubing. Then using the data gathered by any of the methods and/or systems of paragraphs 4. to 8. to establish the wellbore storage coefficient of the casing annulus; allowing determination of any fluid interfaces; allowing the pressure profile of the casing from surface to well depth to be determined; comparing this to the tubing pressure profile to create a differential pressure profile between tubing and casing; adjusting the pressure relief set-point of the well integrity system to have a sufficient margin preventing the collapse or burst of either the production tubing or casing.

10. Using the data from method 9. to estimate the differential pressure profile if the production is shut in and fluids settle out in the production tubing. Adjusting the pressure relief set-point of the Well Integrity System determined in method 7. to have a sufficient margin preventing the collapse or burst of either the production tubing or casing if this is necessary.

11. Using any of the methods and/or systems of paragraphs 1. to 10. to manage safety margins affected by other external factors like cement isolation failure, tubing leak, casing leak, packer leak, loss of annular fluid, gas in annular fluid etc. Applying annulus relief pressure settings appropriate for these faults by remotely programming the Wellbore Integrity System.

12. The method of paragraph 12. to pro-actively modify the annulus relief pressure setting based on the risk of events listed based on the historical trending described in method of paragraph 1.

In general, all the methods 1. to 12. listed above incorporate the following key principles:

a) Install a Wellbore Integrity System on a wellhead with one or more programmable pressure relief valves tied into a casing.

b) More than one casing may have one or more programmable pressure relief valves installed.

c) Each programmable pressure relief valve has a pressure input from a pressure transducer, a programmable logic controller and a programmable high pressure set-point and a programmable low pressure set-point.

d) The high and low pressure set points can be programmed remotely and if desired by a wireless link.

e) The pressure transducer on each casing can be used to measure the trend of pressure build-up or pressure drop over time.

f) A casing pressure above the high pressure set-point will open the programmable pressure relief valve and bleed pressure from the casing. This pressure will drop until the low pressure set-point is reached whereupon the programmable pressure relief valve will close.

g) The pressure may increase again after closing and this pressure increase can be trended over time.

h) The data gathered from several Wellbore Integrity Systems with several programmable pressure relief valves can be used to create methods and procedures for increasing the life of wells and for reduction of risk.

i) Being remotely programmable, the high pressure set-point can be dropped to initiate a bleed of the casing pressure to a desired low pressure set-point and using this process to collect data from the Wellbore Integrity System to enable interpretation of the conditions in the annular casing. Using this data to create methods and procedures for increasing the life of wells and for reduction of risk.

j) Data collected form similar wells with similar completions can be uses to pro-actively program the set-points of the programmable pressure relief valves for increasing the life of wells and for reduction of risk.

k) Using the data created from pro-active controlled bleeding of the casing pressure enables interpretations to be made on the condition of the wellbore and used to create methods and procedures for increasing the life of wells and for reduction of risk.

An illustrative example will demonstrate the main principles of the methods:

a. An annular casing has a programmable pressure relief valve installed on a long producing well (meaning that the temperature heating profile is stable).

b. The initial casing pressure is 500 psi. The high pressure setpoint is set at 1500 psi (within allowable limit for the completion) and the low pressure set-point is set at 500 psi.

c. Over a period of 60 days the pressure climbs to 1000 psi, and with production stable (no additional source of temperature effects) the interpretation is that there is a small leak from somewhere into the casing being monitored.

d. It is desired to do a test (method) to see if the leak is increasing or not and if the current higher casing pressure reduces the leak. There may already be an indication of the pressure trend over the 60 days from 500 psi to 1000 psi.

e. The programmable pressure relief valve low pressure set-point is remotely re-programmed to 800 psi. Then the high pressure set-point is set to 1000 psi down from 1500 psi. The programmable pressure relief valve will open and stay open until the casing pressure drops to 800 psi. The time is measured as 20 mins for this event and at 800 psi the programmable pressure relief valve closes.

f. Now the build-up of pressure is monitored and after 15 days the annular pressure is back to 1000 psi, the programmable pressure relief valve opens automatically and drops the pressure back down to 800 psi. This time the bleed takes 30 minutes.

g. This increased time to bleed means that probably some gas has entered the casing as the volume of the casing is unchanged (unless it has a rupture giving it greater volume). Increased bleed could also be caused by a crack or rupture in casing allowing external fluids from a higher-pressure zone to enter. This is very valuable data and continued use of the Wellbore Integrity System 20 across several wells will give information that was previously not easily accessible.

h. By pro-actively using the system and also by using set-points on problem wells that are programmed to maximize the information gathered, enables interpretations to be made on the condition of the wellbore and used to create methods and procedures for increasing the life of wells and for reduction of risk.

In summary the Wellbore Integrity System 20 enables the following new functions:

i. Constant monitoring of the annulus pressure for desired casings with time;

ii. Local adjustment of annulus pressure between two set points (high and low) at the HMI that is part of the programmable pressure relief valve;

iii Remote adjustment of annulus pressure between two set points (high and low);

iv. A secure, password protected system for making changes;

v. Recording of all valve events and associated data leading up to these events, during and post events;

vi. Ability to characterize the fluid being released from the annulus;

vii. Ability to measure the volume of the fluid being released from the annulus;

viii. The frequency of events enables planning for remedial actions for particular problem wells;

ix. Early indication of well integrity issues detected by casing pressure and casing pressure events, with capability to manage casing pressure;

x. Deployment of a completely autonomous casing pressure and control system with renewable energy power supply;

xi. Possible to deploy the WIS 20 before completing the well for production, during drilling and well testing, to enhance protection for casing shoes and casing failures associated with drilling due to wear, especially in horizontal wells;

xii. Possible to deploy the WIS 20 during remedial workovers or other types of interventions to improve the safety of the operations.

Although the invention has been described with reference to specific embodiments & methods, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth herein in the appended claims.

There may be enhancements and variations of the methods in order or sequence that can be applied by those skilled in the art that such equivalent methods do not depart from the spirit and scope of the invention as set forth herein. It is therefore contemplated that the claims will cover any such modifications or embodiments that fall within the scope of the invention.

What is claimed is:

1. A wellbore integrity monitoring system comprising:

a wellbore lined with a casing string;

a production tubing that extends down the wellbore to a reservoir of formation fluid so that fluid from the reservoir of formation fluid can flow up the production tubing;

a casing annulus formed between an exterior of the production tubing and the casing string;

a fluid flow line that extends from the casing annulus to a vent via a surface deployed skid assembly, wherein the surface deployed skid assembly comprises:

a communication module comprising a transceiver that is configured to transmit data to and receive data and/or instructions from a remote location; and a data storage memory that is configured to store data representing pressure signals received from a pressure sensor of the wellbore integrity monitoring system arranged to measure fluid pressure in the casing annulus;

a pressure relief valve that is provided in the fluid flow line and is movable between a closed position in which flow of a fluid along the fluid flow line from the casing annulus to the vent is prevented and an open position in which flow of the fluid along the fluid flow line from the casing annulus to the vent is allowed;

a valve actuator system that is configured to move the pressure relief valve between the open position and the closed position;

a processor/controller that is connected to the pressure sensor and is configured to receive and process one of the pressure signals received from the pressure sensor, the processor/controller also being connected to the valve actuator system and configured to control the valve actuator system to move the pressure relief valve from the closed position to the open position if the one of the pressure signals from the pressure sensor indicates that the fluid pressure in the casing annulus is greater than a high pressure set point, wherein the processor/controller comprises a data input interface that is connected to the communication module and that is configured to change the high pressure set point to a new value according to instructions from a remote location received at the data input interface;

a renewable power module comprising a solar panel, a charge controller, a storage battery, an air compressor, and a compressed air storage tank, the renewable power module being configured to supply power to the surface deployed skid assembly to that the wellbore integrity monitoring system can operate on power supplied exclusively by the renewable power module; and a fluid-type detection system that is configured to measure a density of the fluid being vented from the fluid flow line.

2. The wellbore integrity monitoring system according to claim 1, wherein the processor/controller is also configured to control the valve actuator system to move the pressure relief valve from the open position to the closed position if the one of the pressure signals from the pressure sensor indicates that the fluid pressure in the casing annulus is lower than a low pressure set point.

3. The wellbore integrity monitoring system according to claim 2, wherein the processor/controller is configured to change the low pressure set point to a new value according to instructions received at the data input interface.

4. The wellbore integrity monitoring system according to claim 2, wherein the wellbore integrity monitoring system is further configured to use the data storage memory to store an event log related to at least one of the following events: a fluid pressure in an interior of the casing annulus reaches the high pressure set point, the fluid pressure in the interior of the casing annulus reaches the low pressure set point, the processor/controller controls the valve actuator system to move the pressure relief valve from the open position to the closed position, and the processor/controller controls the valve actuator system to move the pressure relief valve from the closed position to the open position, the event log containing the date, time and nature of the event.

5. The wellbore integrity monitoring system according to claim 2, wherein the wellbore integrity monitoring system is further configured to transmit to a remote location an event log related to at least one of the following events: a fluid pressure in an interior of the casing annulus reaches the high pressure set point, the fluid pressure in the interior of the casing annulus reaches the low pressure set point, the processor/controller controls the valve actuator system to move the pressure relief valve from the open position to the closed position, and the processor/controller controls the valve actuator system to move the pressure relief valve from the closed position to the open position, the event log containing the date, time and nature of the event.

6. The wellbore integrity monitoring system according to claim 1, wherein the pressure sensor is located in the fluid flow line upstream of the pressure relief valve or is located in the casing annulus.

7. The wellbore integrity monitoring system according to claim 1, wherein the wellbore integrity monitoring system further comprises:

a clock; and wherein the wellbore integrity monitoring system is configured to store data representing data representing the pressure signals received from the pressure sensor and the date and time of receipt of each of the pressure signals.

8. The wellbore integrity monitoring system according to claim 1, wherein the wellbore integrity monitoring system is further configured to record change in the fluid pressure with time after opening the pressure relief valve or closing the pressure relief valve.

9. A method of operating a wellbore monitoring system, wherein the wellbore monitoring system comprises:

a fluid flow line that extends from an interior of a wellbore casing to a vent;

a programmable pressure relief valve that is provided in the fluid flow line and is movable between a closed position in which a flow of the fluid along the fluid flow line from a casing annulus in the interior of a wellbore to the vent is prevented and an open position in which flow of the fluid along the fluid flow line from the casing annulus to the vent is allowed;

a valve actuator system that is configured to move the programmable pressure relief valve between the open position and the closed position;

a pressure sensor that is arranged to measure a fluid pressure in the casing annulus;

a processor/controller that is connected to the pressure sensor and is configured to receive and process a pressure signal from the pressure sensor, the processor/controller also being connected to the valve actuator system and configured to control the valve actuator system to move the programmable pressure relief valve between the closed position and the open position;

wherein the method comprises:

a) using the pressure sensor to monitor the fluid pressure in the casing annulus and if the signal from the pressure sensor indicates that the fluid pressure in the casing annulus is greater than a high pressure set point, using the processor/controller to operate the valve actuator system to move the pressure relief valve from the closed position to the open position;

b) allowing fluid from an interior of the casing annulus to flow to the vent;

c) when the signal from the pressure sensor indicates that the fluid pressure in the interior of the casing annulus is lower than a low pressure set point, using the processor/controller to control the valve actuator system to move the programmable pressure relief valve from the open position to the closed position;

d) measuring a length of time between moving the programmable pressure relief valve to the open position and returning the programmable pressure relief valve to the closed position; and e) using the length of time measured to assess a condition of the wellbore.

10. The method of operating a wellbore monitoring system according to claim 9, further comprising using the pressure sensor to monitor the fluid pressure in the interior of the casing annulus after returning of the programmable pressure relief valve to the closed position, and using the length of time measured and the fluid pressure in the interior of the casing annulus after returning of the programmable pressure relief valve to the closed position to assess the condition of the wellbore.

11. The method of operating a wellbore monitoring system according to claim 10, wherein the wellbore monitoring system further comprises a data storage memory, and the method comprises using the data storage memory to store data representing the pressure signal received from the pressure sensor.

12. The method of operating a wellbore monitoring system according to claim 11, wherein the wellbore monitoring system further comprises a clock, and the method comprises using the data storage memory to store data representing the pressure signal and other pressure signals-received from the pressure sensor, and the date and time of receipt of each of the pressure signal and the other pressure signals.

13. The method of operating a wellbore monitoring system according to claim 9, wherein the wellbore monitoring system further comprises a transmitter and a clock, and the method comprises using the transmitter to transmit the pressure signal from the pressure sensor and the time of receipt of the pressure signal to a remote location.

14. The method of operating a wellbore monitoring system according to claim 9, wherein the processor/controller comprises a data input interface and the method further comprises transmitting instructions to the data input interface of the processor/controller to change one or both of the high pressure set point or the low pressure set point to a new high pressure set point or a new low pressure set point, respectively, and the processor/controller storing the new high pressure set point and/or new low pressure set point.

15. The method of operating a wellbore monitoring system according to claim 9, wherein the processor/controller has a data input interface and the method further comprises using the pressure sensor to determine the fluid pressure in the interior of the casing annulus, transmitting instructions to the data input interface of the processor/controller to reset the high pressure set point to a level below the fluid pressure in the interior of the casing annulus, so that the processor/controller to controls the valve actuator to move the pressure relief valve from the closed position to the open position.

16. The method of operating a wellbore monitoring system according to claim 15, wherein the method comprises using the pressure sensor to determine the flow pressure in the interior of the casing annulus, and the processor/controller to log the pressure signal and other pressure signals from the interior of the casing annulus at intervals while the pressure relief valve is in the open position.

17. The method of operating a wellbore monitoring system according to claim 9, wherein, where the wellbore monitoring system comprises a clock and a data storage memory, the method further comprises using the data storage memory to store an event log related to at least one of the following events: the fluid pressure in the interior of the casing annulus reaches the high pressure set point, the fluid pressure in the interior of the casing annulus reaches the low pressure set point, the processor/controller controls the valve actuator system to move the pressure relief valve from the open position to the closed position, and the processor/controller controls the valve actuator system to move the pressure relief valve from the closed position to the open position, the event log containing the date, time and nature of the event.

18. The method of operating a wellbore monitoring system according to claim 9, wherein, where the wellbore monitoring system comprises a clock and a transmitter, the method further comprises using the data storage memory to transmit to a remote location an event log related to at least one of the following events: the fluid pressure in the interior of the casing annulus reaches the high pressure set point, the fluid pressure in the interior of the casing annulus reaches the low pressure set point, the processor/controller controls the valve actuator system to move the pressure relief valve from the open position to the closed position, and the processor/controller controls the valve actuator system to move the pressure relief valve from the closed position to the open position, the event log containing the date, time and nature of the event.

19. The method of operating a wellbore monitoring system according to claim 9, further comprising measuring a density of the fluid flowing to the vent.

20. The method of operating a wellbore monitoring system according to claim 19, further comprises:

determining a volume of the fluid flowing to the vent; and using the length of time measured and the volume of the fluid flowing to the vent to assess the condition of the wellbore.

21. The method of operating a wellbore monitoring system according to claim 9, further comprising using the length of time and a density of the fluid flowing to the vent to assess the condition of the wellbore.

22. The method of operating a wellbore monitoring system according to claim 9, further comprises:

determining a volume of the fluid flowing to the vent; and using the length of time measured and the volume of the fluid flowing to the vent to assess the condition of the wellbore.

* * * * *